US008925968B2

(12) United States Patent
Sada et al.

(10) Patent No.: US 8,925,968 B2
(45) Date of Patent: Jan. 6, 2015

(54) COMPOSITION BOOK

(75) Inventors: Denise E. Sada, Centerville, OH (US); Bobby G. James, Jr., Miamisburg, OH (US)

(73) Assignee: Acco Brands Corporation, Lake Zurich, IL (US)

( * ) Notice: Subject to any disclaimer, the term of this patent is extended or adjusted under 35 U.S.C. 154(b) by 364 days.

(21) Appl. No.: 12/996,808

(22) PCT Filed: Sep. 22, 2009

(86) PCT No.: PCT/US2009/057796

§ 371 (c)(1), (2), (4) Date: Dec. 8, 2010

(87) PCT Pub. No.: WO2010/036637

PCT Pub. Date: Apr. 1, 2010

(65) Prior Publication Data

US 2011/0089675 A1 Apr. 21, 2011

Related U.S. Application Data

(60) Provisional application No. 61/099,775, filed on Sep. 24, 2008.

(51) Int. Cl.

| | |
|---|---|
| ***B21D 19/00*** | (2006.01) |
| ***B42D 1/00*** | (2006.01) |
| ***B42F 3/00*** | (2006.01) |
| ***B43K 23/00*** | (2006.01) |

(52) U.S. Cl.

CPC ..... *B42D 1/004* (2013.01); *B42D 1/009* (2013.01); *B42F 3/003* (2013.01); *B43K 23/001* (2013.01); *B42P 2241/02* (2013.01); *B42P 2241/04* (2013.01); *B42P 2241/18* (2013.01)

USPC ..... 281/9

(58) Field of Classification Search

USPC ..... 281/27, 9, 12

See application file for complete search history.

(56) References Cited

U.S. PATENT DOCUMENTS

| | | | | |
|---|---|---|---|---|
| 4,618,166 | A | 10/1986 | Hsi | |
| 4,773,676 | A * | 9/1988 | Showering | 281/2 |
| 5,328,409 | A * | 7/1994 | Marquardt | 462/17 |
| 5,749,567 | A * | 5/1998 | DeAngelis | 270/7 |
| 6,431,780 | B2 | 8/2002 | Moor et al. | |
| 2003/0021624 | A1 * | 1/2003 | Dorsey | 402/73 |
| 2003/0210948 | A1 * | 11/2003 | James, Jr. | 402/57 |
| 2006/0017278 | A1 * | 1/2006 | Wood | 283/56 |

FOREIGN PATENT DOCUMENTS

JP 2004-174907 6/2004

OTHER PUBLICATIONS

My Binding, Perforated Copy Paper, http://web.archive.org/web/20070217041026/http://www.mybinding.com/.sc/ms/cat/3-Ring%20Binders--Perforated%20Papers, Feb. 17, 2007.*

WO2010036637, International Search Report and International Preliminary Report for PCT/US2009/057796, mailed Nov. 10, 2009.

Office Action dated Mar. 19, 2013, Canadian Application No. 2,727,527.

* cited by examiner

*Primary Examiner* — Shelley Self

*Assistant Examiner* — Matthew G Katcoff

(74) *Attorney, Agent, or Firm* — Thompson Hine L.L.P.

(57) ABSTRACT

A composition book having a front and back cover and a plurality of pages stitched together wherein the plurality of pages may have hole punches and the front and back cover may have hole punches such as to allow the composition book to fit within a binder and wherein the plurality of pages are perforated such that they may be removed from the composition book.

17 Claims, 3 Drawing Sheets

COMPOSITION BOOK

REFERENCE TO RELATED APPLICATION

This application claims the benefit of priority under 35 U.S.C. §119(e) of provisional application Ser. No. 61/099,775 filed on Sep. 24, 2008, which is hereby incorporated by reference in its entirety.

BACKGROUND OF THE INVENTION

The present invention relates to a composition notebook and more particularly to a composition notebook having perforated pages.

DESCRIPTION OF THE ART

Composition notebooks in their most general state consist of sheets folded in half and attached together by an attaching means such as staples or stitching or the like. Some composition books may have hard covers others may have soft covers or no cover at all. Books of this type (formed by a plurality of folded sheets) are well known in the art. Traditionally these books are used for labs in school, art sketch books, race books, crossword puzzle books or the like. Due to the nature of the books' simple construction, namely the folding of the plurality of pages to form an almost v-shape at the spine, the edges of the pages on the outside of the book do not perfectly line up with the edges of the pages in the middle of the book as a result this format is not ideal for removable pages due to the variation in page sizes. However, there is a need for a composition book format that is easily manufactured, has removable pages, but still maintains close to the same page size when the pages are removed from the book.

SUMMARY OF THE INVENTION

The main objective of the invention is to provide a composition book with perforated pages wherein the page sizes of the removed pages vary only slightly depending upon the pages location in the book prior to removal. A composition book in accordance with the present invention may comprise more than one set of a plurality of sheets attached together by an attaching means wherein one set of a plurality of sheets is perforated at a predetermined distance from the centerline (stitching line) and another set of a plurality of sheets is perforated at a slightly greater pre-determined distance from said centerline. It is to be understood that such a variation in the perforations distance from the centerline may minimize the variation in page size caused by the folding of the sheets for the book's formation. It is to be understood that such a book may have a front and back cover. It is to be understood that holes may be drilled into the pages of the composition book such that the pages may be removed and added to a separate binder. It is to be further understood that holes may be drilled into the cover as well as the pages. Other objectives, advantages and novel features of the invention will become more apparent from the following detailed description.

DETAILED DESCRIPTION OF THE PREFERRED EMBODIMENT

Figure 1A:
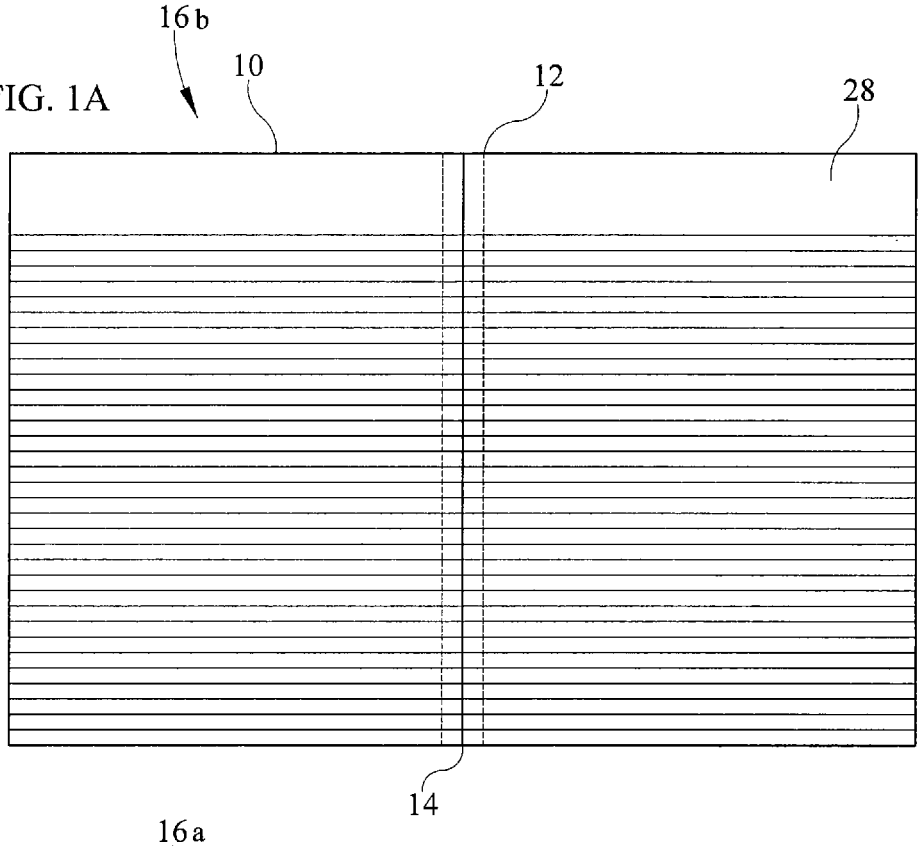
FIGS. 1A & B are a plan view of two sets of sheets, indicating the page portion of the sheets, prior to their combination to form the composition book and presenting possible page and sheet dimensions.

The composition book of the present invention may comprise a cover and more than one set (section) of a plurality of sheets wherein such plurality of sheets may be stitched together and may have perforations to form removable pages. It is to be further understood that the composition book or the pages of the composition book may have holes drilled such that the book or the pages may be placed into a binder. It is to be understood that a cover is not necessary for the claimed invention.

With reference to FIG. 1, the sheet 10 may be rectangular in dimension. It is to be understood that the sheet dimension may be square. It is to be understood that the sheet dimension may include sides that are shorter in length than the top and/or bottom. It is to be understood that the exact dimensions could be of any size based on manufacturing preferences. It is to be understood that the length of the top may be up to 40 inches, or up to 30 inches, or up to 20 inches, or up to 16 inches, or up to 10 inches, or up to 5 inches. It is to be understood that the length of the sides may be up to 40 inches, or up to 30 inches, or up to 20 inches, or up to 16 inches, or up to 11 inches, or up to 5 inches. It is to be understood that the corners of the sheets 10 may be shaped such that they match the corners of the cover 20. It is to be understood that the removable pages 28 are formed by the perforations 12 on either side of the center-line. It is to be understood that the sheet and page sizes are not limited to the dimensions shown in FIG. 1.

It is further to be understood that the sheets 10 may be lined. It is to be understood that the sheets 10 may be blank. It is to be understood that the sheets 10 may contain a grid. It is to be understood that the sheets 10 may be filled with pre-printed indicia. It is to be understood that other lines, tables etc may be pre-printed on the sheets 10.

The center-line 14 is located in the middle of sheet 10. It is to be understood that the centerline could be slightly off center if manufacturing preferences desired with only a slight effect on the removable pages 28 sizes. The plurality of sheets 10 are attached together along center-line 14 at attachment points 30. The plurality of sheets 10 may be attached together by stitching, staples or any other appropriate means to bind the sheets together along a center-line 14. When laid flat the center-line acts as the point of a V-shape 26 for the sheets 10. The composition book 18 folds at center-line 14.

The perforations 12 are located on either side of the center-line 14. The distance of the perforations 12 from the center-line 14 may be up to ¼ of an inch from the center-line 14, up to ⅓ of an inch from the center-line 14, up to ⅜ of an inch from the center-line 14, up to ½ of an inch from the center-line 14, up to ⅝ of an inch from the center-line 14, up to ¾ of an inch from the center-line 14, up to 1 inch from the center-line 14, up to 1.5 inches from the center-line 14, up to 2 inches from the center-line 14 or other distance that manufacturing preferences may dictate. It is to be understood that the desired location for the perforations 12 relative to the center-line 14 may depend upon the length and width of the notebook.

The plurality of sheets 10 may be divided into multiple sections 16. The sections 16 may include up to thirty sheets 10, up to twenty sheets 10, up to fifteen sheets 10, up to ten sheets 10, up to five sheets 10, up to three sheets 10. The number of sheets 10 appropriate for each section 16 may depend upon the sections location within the book 18. The outermost sections 16*a* of the book 18 may contain less sheets 10 in their sections 16 than the innermost sections 16*b*. For example, the innermost sections 16*b* of the book 18 may contain sections 16 of sheets 10, the next sections 16 may contain 15 sheets 10 and the outermost sections 16*a* may contain 10 sheets 10.

To keep the separated pages 28 about the same size as the other separated pages 28 from the composition book 18, the perforations 12 may be staggered or, in other words, the distance of the perforations 12 from the centerline 14 may vary between the various sheet sections 16. The distance of the perforations from center-line 14 may be up to ¼ of an inch, up to ⅓ of an inch, up to ½ of an inch, up to ¾ of an inch, up to 1 inch, up to 2 inches, up to 3 inches, or a manufacturing preferred combination of these distances.

The plurality of sheets 10 that make up the composition book may be divided into as many sections 16 as manufacturing preferences determine appropriate. For example, the plurality of sheets 10 may be divided into up to 6 sections 16, up to 4 sections 16, or up to 2 sections 16. The perforations 12 on the sheets 10 within in each section 16 may vary in distance from the centerline 14 as compared to another section 16 of sheets 10. The ratio of the variation in distance between the centerline 14 and the perforations 12 as compared between one or more sections 16 may be up to 3:4 ratio, up to 7:8 ratio, up to 1:2 ratio. For example, the innermost section 16*b* of sheets may have a perforation distance from the center-line 14 of 0.375 inches and the outermost section 16*a* of sheets may have a perforation distance from the center-line 14 of 0.5 inches, giving a ratio of 3:4 for the variation in distance of the perforations 12 from the center-line 14. Another section 16 of sheets could be added to the outside of the second sheet section 16 with a perforation distance from the center-line 14 of about 0.666 inches. It is to be understood that additional sections 16 may be added as well increasing the distance of the perforations 12 from the center-line 14 as the sections get further from the innermost section of the book 18.

The outermost section 16*a* may have the greatest distance between the center-line 14 and the perforations 12. The innermost section 16*b* may have the shortest distance between the center-line 14 and the perforations 12. The variations between the size of the pages 28 may be less than one inch, less than half an inch, less than a quarter of an inch, less than ⅛ of an inch, or less than 1/10 of an inch. The amount of variation that is acceptable between the pages 28 may be determined by manufacturing preferences.

It is to be understood that the composition book 18 may have hole punches 22 drilled into the book 18. It is to be understood that the cover 20 may have hole punches 22 such that the entire composition book 18 may be added to a binder. It is to be understood that only the pages 28 may have holes 22 drilled into them such that the pages 28 once removed from the composition book 18 may be added to a binder. It is to be understood that the holes 22 may be placed on the spine 24 side of the book 18 and/or pages 28. It is to be understood that the holes may be located along the top or bottom ends of the book 18 and/or sheets 10. It is to be understood that the holes 22 are positioned such that they fall within the parameters of the page 28 once removed from the composition book 18. It is further to be understood that the book 18 or pages 28 may have up to 10 holes, up to 8 holes, up to 6 holes, up to 3 holes, or up to 2 holes. It is to be understood that the number and location of these holes 22 may be determined by manufacturing preferences. It is to be understood that the holes 22 may be drilled prior to attaching the cover 20. It is to be understood that the holes 22 may be drilled after attaching the cover 20.

The cover 20 of the composition book 18 may be attached to the one or more sections 16 of sheets 10. The cover 20 of the composition book 18 may be attached using adhesive. The cover 20 of composition book 18 may be attached using stitching or staples or any other appropriate means. The cover 20 of the composition book 18 may be soft. The cover 20 of the composition book 18 may be composed of a stiff material. The cover 20 of the composition book 18 may be made of paperboard, treated paperboard, plastic, or plastic-like materials. The cover 20 of the composition book 18 may have an attachment to hold the book closed. Such an attachment may be a strap, a band, magnetic, or a snap or buckle type attachment. The cover of the composition book may be made to hold a writing instrument. The writing instrument may be held by a snap in or strap in or slide in type holder. The writing instrument holder may be a groove set in the cover 20 so as to allow a writing instrument to more easily and securely clip onto the outer cover.

It is to be understood that a similar result of maintaining close to the same removable page 28 size could be achieved by using sheets 10 that are slightly larger by sheet section 16 by similar ratios as the differences in perforation distances from center-line 14, namely up to 3:4, up to 7:8, or up to 1:2. It is too be understood that the larger sheets 10 should be on the outside and in such an instance the perforation 12 may still be staggered as described previously. Such a combination would further reduce the slight variation in the removable page 28 sizes, while still allowing for ease of removal from the bound composition book 18. However, it is understood that there are increased complexities involved with using different sized sheets that may make the manufacturing of a composition book by this means impractical from a manufacturing stand point. There is a recognized ease in manufacturing books using the same size sheets divided into the sections, perforated and attached together as described previously because only one size sheet is needed to be made, and a variety of sized sheets do not need to be combined by the manufacturing machines.

Figure 1B:
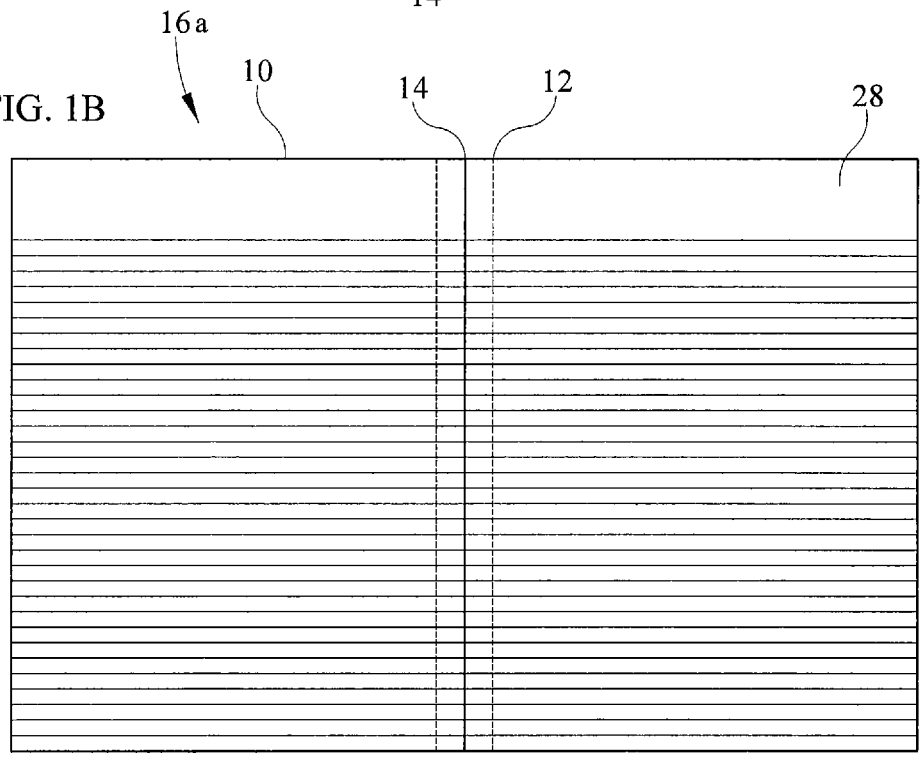

FIGS. 1A and B show two sample plurality of sheet sections 16 and example dimensions. As shown, the perforation line 12 varies in distance from center-line 14 between the two sheet sections 16. For example the sheet section 18 depicted in FIG. 1A may have a distance of about 0.375" between the perforation line 12 and the center-line 14, while the sheet section 18 depicted in FIG. 1B may have a distance of about 0.5" between the perforation line 12 and the center-line 14. In this example the second sheet section 16 depicted in FIG. 1B would be the outermost sheet section 16*a*. The sheet section in FIG. 1A may be set atop the second sheet section 16 in FIG. 1B and the two attached together along center-line 14. A cover may be attached as well.

Figure 2:
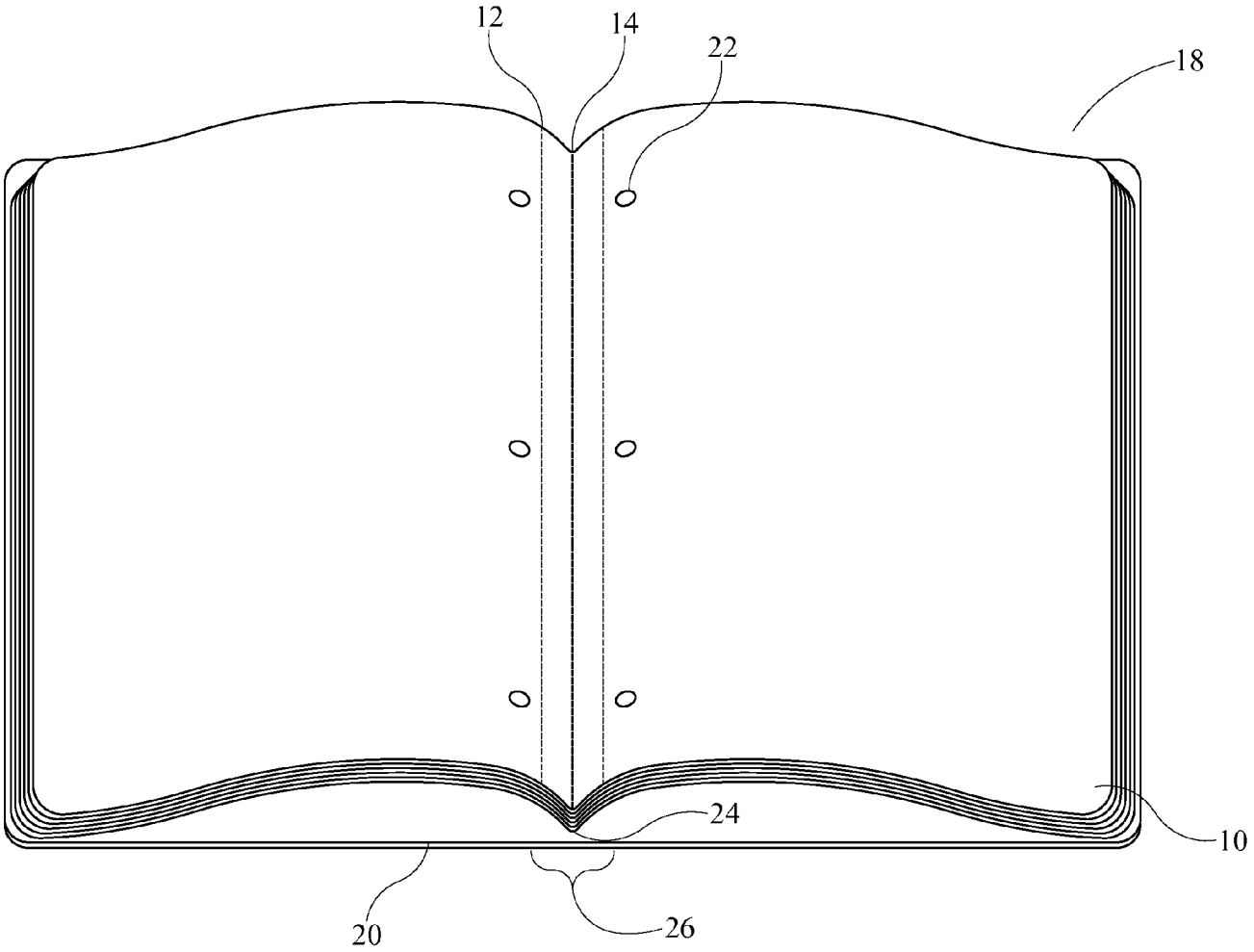
FIG. 2 is a perspective view of an open composition book.

FIG. 2 shows an example of an open composition book 18 at center-line 14. Where the sheets are attached together along center-line 14 a v-shape 26 is formed at the spine 24 when in this open position.

Figure 3:
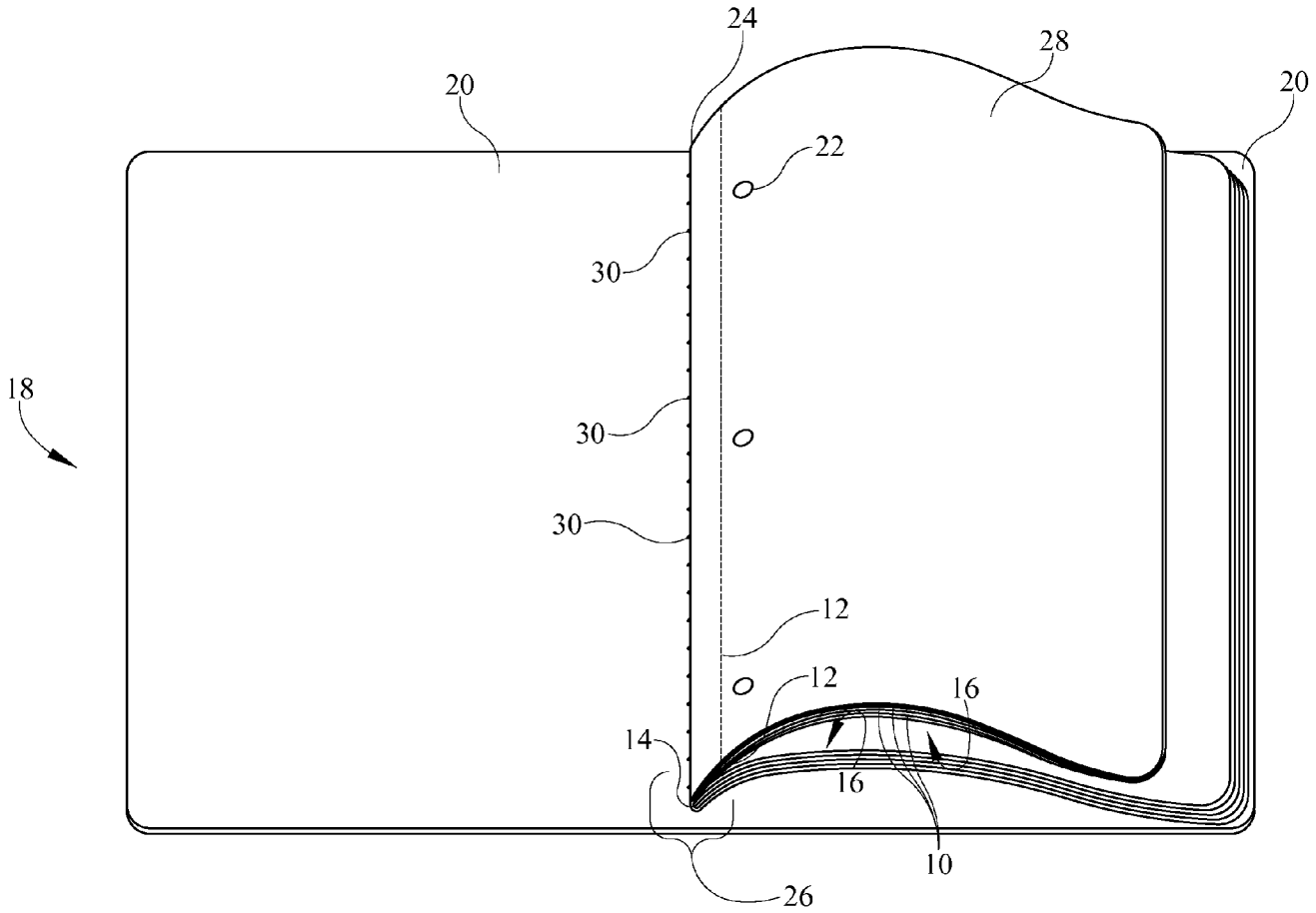
FIG. 3 is a perspective view of a composition book as it appears when opened to the first or last page.

FIG. 3 shows an example of a composition book 18 open to its first page. Stitching 30 is shown along the spine 24 and in this example, depicts where the plurality of sheet sections 16 and cover 20 are attached together. The v-shape 26 is folded over and creates a small loop where center-line 14 has been folded upon itself.

Although various aspects of the disclosed packaging structures have been shown and described, modifications may occur to those skilled in the art upon reading the specification.

The invention claimed is:

1. A composition book comprising:

a first set of pages, and a second set of pages, wherein said first and second sets of pages are coupled together along a coupling line, wherein said pages of said first set of pages and said second set of pages each have at least one tear guideline generally parallel to the coupling line, wherein only one of said tear guidelines on each page extends from a first outer edge to a second opposite outer edge of the associated page and intersects both the associated outer edges, such that individual pages may be entirely removed from the composition book, and wherein the position of the only one tear guidelines of the respective pages of said first set of pages relative to the coupling line is different from the position of the only one tear guideline of the respective pages of the second set of pages relative to the coupling line.

2. The composition book of claim 1 further comprising a front cover and a back cover, and wherein said front cover and said back cover are attached to at least one of said first set of pages or said second set of pages.

3. The composition book of claim 1 wherein the pages of the first and second sets of pages each have at least one hole formed therethrough, wherein the at least one hole is located along the same side of the paper as a spine of the book, and wherein the tear guidelines are positioned between the associated at least one hole and the coupling line.

4. The composition book of claim 1 wherein the first set of pages has tear guidelines located up to ⅜ of an inch from the coupling line, and wherein the second set of pages has tear guidelines located up to ½ of an inch from the coupling line.

5. The composition book of claim 1 wherein the first set of pages is located closer to a middle of the composition book than the second set of papers, and wherein said tear guidelines of said first set of pages are located closer to said coupling line than said tear guidelines of said second set of pages.

6. The composition book of claim 1 wherein the second set of pages is located on the outside of the first set of pages, and wherein said tear guidelines of said first set of pages are located closer to said coupling line than said tear guidelines of said second set of pages.

7. The composition book of claim 2 wherein the front and back cover are stitched to at least one of said sets of pages.

8. The composition book of claim 2 wherein said first set of pages is positioned closer to at least one of said back or front covers than said second set of pages, and wherein a distance between the tear guideline and the coupling line of the first set of pages is greater than a distance between the tear guideline and the coupling line of the second set of pages.

9. The composition book of claim 1 wherein each set of pages includes one or more pages.

10. The composition book of claim 1 wherein the tear guidelines are perforations.

11. The composition book of claim 1 wherein said coupling line defines a spine of said composition book about which each page is pivotally foldable.

12. A composition book comprising:

an outer section containing at least one sheet folded about a center-line; and an inner section containing at least one sheet folded about a center-line, wherein the first section and the second section are arranged such that the center-line of the outer section and the center-line of the inner section are aligned, wherein the at least one sheet of the outer section has first and second tear guidelines oriented parallel or approximately parallel with the associated center-line and located equidistantly or approximately equidistantly at a first distance on either side of the associated center-line, wherein the at least one sheet of the inner section has first and second tear guidelines oriented parallel or approximately parallel with the associated center-line and located equidistantly or approximately equidistantly at a second distance on either side of the associated center-line, wherein the first distance is different from the second distance, and wherein the first and second tear guidelines of the at least one sheet of the inner section and the at least one sheet of the outer section are the only tear guidelines parallel or approximately parallel with the associated center-lines and extending from one outer edge to an opposite outer edge of the respective at least one sheet.

13. The composition book of claim 12 wherein the outer section is attached to a cover.

14. The composition book of claim 12 wherein the first distance is greater than the second distance.

15. The composition book of claim 1 wherein the individual pages of the first set of pages and the individual pages of the second set of pages are generally the same size.

16. The composition book of claim 1, wherein said individual pages may be entirely removed from the composition book solely by tearing along the associated tear guidelines.

17. The composition book of claim 1, wherein said first and second edges are parallel and positioned on opposite sides of the associated page.

* * * * *